US010287658B2

(12) United States Patent
Okonogi et al.

(10) Patent No.: US 10,287,658 B2
(45) **Date of Patent: *May 14, 2019**

(54) WIRE MATERIAL FOR NON-HEAT TREATED COMPONENT, STEEL WIRE FOR NON-HEAT TREATED COMPONENT, AND NON-HEAT TREATED COMPONENT AND MANUFACTURING METHOD THEREOF

(75) Inventors: Makoto Okonogi, Tokyo (JP); Shingo Yamasaki, Tokyo (JP); Akifumi Kawana, Tokyo (JP); Hideaki Gotohda, Tokyo (JP)

(73) Assignee: NIPPON STEEL AND SUMITOMO METAL CORPORATION, Tokyo (JP)

( * ) Notice: Subject to any disclaimer, the term of this patent is extended or adjusted under 35 U.S.C. 154(b) by 408 days.

This patent is subject to a terminal disclaimer.

(21) Appl. No.: 14/240,597

(22) PCT Filed: Aug. 23, 2012

(86) PCT No.: PCT/JP2012/071323

§ 371 (c)(1),
(2), (4) Date: Mar. 24, 2014

(87) PCT Pub. No.: WO2013/031640

PCT Pub. Date: Mar. 7, 2013

(65) Prior Publication Data

US 2014/0290806 A1 Oct. 2, 2014

(30) Foreign Application Priority Data

Aug. 26, 2011 (JP) ..... 2011-184737

(51) Int. Cl.

| | |
|---|---|
| ***C22C 38/00*** | (2006.01) |
| ***C21D 8/06*** | (2006.01) |
| ***C22C 38/04*** | (2006.01) |
| ***C22C 38/14*** | (2006.01) |
| ***C22C 38/02*** | (2006.01) |
| ***C22C 38/06*** | (2006.01) |
| ***C22C 38/12*** | (2006.01) |
| ***C22C 38/22*** | (2006.01) |

(52) U.S. Cl.

CPC ..... *C22C 38/002* (2013.01); *C21D 8/06* (2013.01); *C21D 8/065* (2013.01); *C22C 38/001* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C21D 2211/002* (2013.01); *C21D 2211/005* (2013.01); *C21D 2211/009* (2013.01)

(58) Field of Classification Search

CPC . C22C 38/04; C22C 38/002; C21D 2211/009; C21D 8/06

USPC ..... 148/320

See application file for complete search history.

(56) References Cited

U.S. PATENT DOCUMENTS

| | | | | |
|---|---|---|---|---|
| 6,605,166 | B2 * | 8/2003 | Koike | C21D 9/0093 148/587 |
| 8,864,920 | B2 * | 10/2014 | Yamasaki | C21D 8/065 148/330 |
| 9,255,306 | B2 * | 2/2016 | Yamasaki | C21D 8/08 |
| 2006/0048864 | A1 | 3/2006 | Nagao et al. | |
| 2013/0133789 | A1 * | 5/2013 | Okonogi | C21D 8/02 148/596 |
| 2016/0129489 | A1 | 5/2016 | Okonogi et al. | |
| 2016/0145712 | A1 | 5/2016 | Okonogi et al. | |

FOREIGN PATENT DOCUMENTS

| | | | |
|---|---|---|---|
| JP | 2-274810 | A | 11/1990 |
| JP | 2000-144306 | A | 5/2000 |
| JP | 2009-275252 | A | 11/2009 |
| JP | 2010-159476 | A | 7/2010 |
| MX | 2013-001724 | A | 3/2013 |
| WO | WO 2007-001057 | A1 | 1/2007 |

(Continued)

OTHER PUBLICATIONS

International Search Report issued in PCT/JP2012/071323 dated Nov. 20, 2012.

Written Opinion of the International Searching Authority issued in PCT/JP2012/071323 dated Nov. 20, 2012.

Office Action issued in U.S. Appl. No. 13/816,835, dated Sep. 1, 2016.

Office Action issued in the corresponding Mexican Patent Application No. MX/a/2014/002069, dated Mar. 12, 2018, with an English translation.

(Continued)

*Primary Examiner* — Weiping Zhu

(74) *Attorney, Agent, or Firm* — Birch, Stewart, Kolasch & Birch, LLP

(57) ABSTRACT

A wire material used for manufacturing a non-heat treated component whose tensile strength is 900 MPa to 1300 MPa, containing, in mass %: C: 0.20% to 0.50%, Si: 0.05% to 2.0%, Mn: 0.20% to 1.0%, being limited to contain P: 0.030% or less, S: 0.030% or less, N: 0.005% or less, F1 defined by the following expression (1) is less than 0.60, with the balance made up of Fe and inevitable impurities, wherein a metal structure contains a pearlite structure of 64×(C %)+52% or more in a volume fraction, with the balance made up of one kind or two kinds of a pro-eutectoid ferrite structure and a bainite structure, an average block grain diameter of the pearlite structure at a region from a surface layer to 0.1 D is 15 μm or less when a diameter of the wire material is set to be D, and (the average block grain diameter of the pearlite structure at the region from the surface layer to 0.1 D)/(an average block grain diameter of the pearlite structure at a range from 0.25 D to a center) is less than 1.0.

$$F1=C\ (\%)+Si\ (\%)/24+Mn\ (\%)/6 \quad (1)$$

20 Claims, 1 Drawing Sheet

(56) References Cited

FOREIGN PATENT DOCUMENTS

| | | | |
|---|---|---|---|
| WO | WO 2011/062012 | A1 | 5/2011 |
| WO | WO 2012/023483 | A1 | 2/2012 |

OTHER PUBLICATIONS

Brazilian Search Report and Technical Examination Report, published Jun. 26, 2018, for corresponding Brazilian Application No. 112014003823-6, with English translations.

Indian Office Action, dated Jan. 4, 2019, for corresponding Indian Application No. 1971/DELNP/2014, along with an English translation.

* cited by examiner

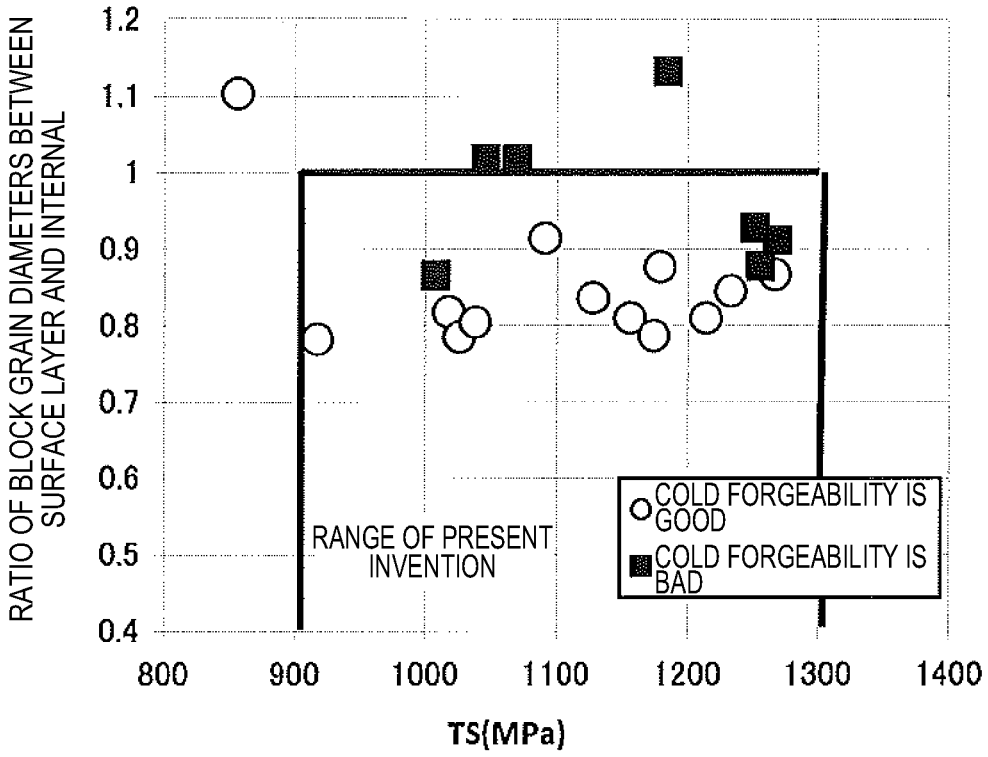
RATIO OF BLOCK GRAIN DIAMETERS BETWEEN SURFACE LAYER AND INTERNAL
1.2
1.1
1
0.9
0.8
0.7
0.6
0.5
0.4
800
900
1000
1100
1200
1300
1400
TS(MPa)
RANGE OF PRESENT INVENTION
COLD FORGEABILITY IS GOOD
COLD FORGEABILITY IS BAD

WIRE MATERIAL FOR NON-HEAT TREATED COMPONENT, STEEL WIRE FOR NON-HEAT TREATED COMPONENT, AND NON-HEAT TREATED COMPONENT AND MANUFACTURING METHOD THEREOF

TECHNICAL FIELD

The present invention relates to a non-heat treated component manufactured from a wire material, used for automotive parts and various industrial machineries having an axial shape such as a bolt, a torsion bar, a stabilizer, and whose tensile strength is 900 MPa to 1300 MPa, a steel wire to manufacture the above, further, the wire material to manufacture the steel wire, and a manufacturing method thereof. Note that, architectural bolts and so on are included in machine components being objects of the present invention. This application is based upon and claims the benefit of priority of the prior Japanese Patent Application No. 2011-184737, filed on Aug. 26, 2011, the entire contents of which are incorporated herein by reference.

BACKGROUND ART

A high-strength machine component having a tensile-strength of 900 MPa or more is used for a vehicle and various industrial machineries to reduce weight and size thereof. Conventionally, this kind of high-strength machine component is manufactured by using steel materials of an alloy steel and a special steel in which alloying elements such as Mn, Cr, Mo, or B are added to a carbon steel for machine structural use, performing spheroidizing annealing after hot-rolling to soften the material, forming into a predetermined shape by performing cold forging and form rolling, and thereafter, supplying strength by performing a quench-hardening and tempering process.

However, a steel cost of these steel materials is high because the alloying elements are contained, and a manufacturing cost thereof increases because soften annealing before it is formed into a component shape and the quench-hardening and tempering process after the forming are required.

An art is known in which wire drawing is performed for a wire material whose strength is increased by quick cooling, precipitation strengthening, and so on without performing the soften annealing and the quench-hardening and tempering process to supply a predetermined strength. This art is used for a bolt and so on, and the bolt manufactured by using this art is called as a non-heat treated bolt.

In Patent Document 1, a manufacturing method of the non-heat treated bolt is disclosed in which a wire material containing C: 0.15% to 0.30%, Si: 0.03% to 0.55%, Mn: 1.1% to 2.0% is cooled in a boiling water bath, and a drawing process is performed with a reduction of area of 20% to 50%. In this manufacturing method, it is possible to omit the spheroidizing annealing and the quench-hardening and tempering process, but a maximum strength of the bolt described in the example is 88 kgf/mm$^2$, and it cannot be said that this bolt has enough strength, and there is a limit in high-strengthening.

In Patent Document 2, a cold forging steel containing C: 0.4% to 1.0%, whose chemical composition satisfies a specific conditional expression, and whose structure is made up of pearlite and pseudo pearlite is disclosed. A C amount of this steel is large, and cold forgeability thereof deteriorates compared to a carbon steel for machine structural use and an alloy steel for machine structural use which are conventionally used for machine components such as a bolt.

As stated above, a machine component having good cold forgeability and a strength of 900 MPa or more and a steel wire and a wire material to manufacture the above cannot be obtained by non-heat treated wire materials according to the conventional arts.

PRIOR ART DOCUMENT

Patent Document

Patent Document 1: Japanese Laid-open Patent Publication No. H02-274810

Patent Document 2: Japanese Laid-open Patent Publication No. 2000-144306

DISCLOSURE OF THE INVENTION

Problems to be Solved by the Invention

The present invention is made in consideration of the above-stated problems in the conventional arts, and an object thereof is to provide (a) a high-strength machine component capable of being manufactured at low-cost, and having a tensile strength of 900 MPa to 1300 MPa, (b) a steel wire used for manufacturing the machine component, and capable of omitting heat treatments such as soften annealing and quench-hardening and tempering process, (c) a wire material to manufacture the steel wire, and (d) a manufacturing method manufacturing the above.

Means for Solving the Problems

The present inventors investigated a relationship between a chemical composition and a structure of a steel material to obtain a high-strength machine component having a tensile strength of 900 MPa or more capable of performing cold forging even if softening heat treatment is not performed and without performing a thermal refining process such as quench-hardening and tempering to attain the above-stated object. The present invention is made based on a metallurgical knowledge obtained by the investigation, and an outline thereof is as described below.

[1]

A wire material for a non-heat treated component used for manufacturing the non-heat treated component whose tensile strength is 900 MPa to 1300 MPa, contains, in mass %:

C: 0.20% to 0.50%, Si: 0.05% to 2.0%, Mn: 0.20% to 1.0%, being limited to contain P: 0.030% or less, S: 0.030% or less, N: 0.005% or less, F1 defined by the following expression (1) is less than 0.60, with the balance made up of Fe and inevitable impurities, wherein a metal structure contains a pearlite structure of 64×(C %)+52% or more in a volume fraction with the balance made up of one kind or two kinds of a pro-eutectoid ferrite structure and a bainite structure, an average block grain diameter of the pearlite structure at a region from a surface layer to 0.1 D is 15 μm or less when a diameter of the wire material is set to be D, and (the average block grain diameter of the pearlite structure at the region from the surface layer to 0.1 D)/(an average block grain diameter of the pearlite structure at a range from 0.25 D to a center) is less than 1.0.

$$F1=C\ (\%)+Si\ (\%)/24+Mn\ (\%)/6 \quad (1)$$

[2]

The wire material for the non-heat treated component according to [1], further contains, in mass %:

one kind or two or more kinds from among Al: 0.003% to 0.050%, Ca: 0.001% to 0.010%, Mg: 0.001% to 0.010%, Zr: 0.001% to 0.010%.

[3]

A manufacturing method of a wire material for a non-heat treated component used for manufacturing the non-heat treated component whose tensile strength is 900 MPa to 1300 MPa, includes:

heating a steel billet containing, in mass %, C: 0.20% to 0.50%, Si: 0.05% to 2.0%, Mn: 0.20% to 1.0%, being limited to contain P: 0.030% or less, S: 0.030% or less, N: 0.005% or less, F1 defined by the following expression (1) is less than 0.60, with the balance made up of Fe and inevitable impurities;

hot-rolling into a wire material shape;

coiling at a coiling temperature of 800° C. to 900° C.;

cooling at a cooling rate of 20° C./s to 100° C./s from a coiling finish temperature to 600° C., further cooling at the cooling rate of 20° C./s or less from 600° C. to 550° C.;

thereafter, isothermally holding in a molten salt tank 1 at 400° C. to 600° C. and a successive molten salt tank 2 at 500° C. to 600° C. for 5 seconds to 150 seconds each; and subsequently cooling.

$$F1=C\ (\%)+Si\ (\%)/24+Mn\ (\%)/6 \quad (1)$$

[4]

A steel wire for a non-heat treated component used for manufacturing the non-heat treated component whose tensile strength is 900 MPa to 1300 MPa, contains, in mass %:

C: 0.20% to 0.50%, Si: 0.05% to 2.0%, Mn: 0.20% to 1.0%, being limited to contain P: 0.030% or less, S: 0.030% or less, N: 0.005% or less, F1 defined by the following expression (1) is less than 0.60, with the balance made up of Fe and inevitable impurities, wherein a metal structure contains a pearlite structure of 64×(C %)+52% or more in a volume fraction with the balance made up of one kind or two kinds of a pro-eutectoid ferrite structure and a bainite structure, an average block grain diameter of the pearlite structure at a region from a surface layer to 0.1 D is 15 μm or less when a diameter of the steel wire is set to be D, and (the average block grain diameter of the pearlite structure at the region from the surface layer to 0.1 D)/(an average block grain diameter of the pearlite structure at a range from 0.25 D to a center) is less than 1.0, an area ratio of a structure made up of a pearlite block whose aspect ratio is 2.0 or more is 70% or more relative to a whole pearlite structure at a region from a surface layer to 1.0 mm at a cross section in parallel to an axial direction of the steel wire.

$$F1=C\ (\%)+Si\ (\%)/24+Mn\ (\%)/6 \quad (1)$$

[5]

The steel wire for the non-heat treated component according to [4], further contains, in mass %:

one kind or two or more kinds from among Al: 0.003% to 0.050%, Ca: 0.001% to 0.010%, Mg: 0.001% to 0.010%, Zr: 0.001% to 0.010%.

[6]

A manufacturing method of a steel wire for a non-heat treated component used for manufacturing the non-heat treated component whose tensile strength is 900 MPa to 1300 MPa, includes:

heating a steel billet containing, in mass %, C: 0.20% to 0.50%, Si: 0.05% to 2.0%, Mn: 0.20% to 1.0%, being limited to contain P: 0.030% or less, S: 0.030% or less, N: 0.005% or less, F1 defined by the following expression (1) is less than 0.60, with the balance made up of Fe and inevitable impurities;

hot-rolling into a wire material shape;

coiling at a coiling temperature of 800° C. to 900° C.;

cooling at a cooling rate of 20° C./s to 100° C./s from a coiling finish temperature to 600° C., further cooling at the cooling rate of 20° C./s or less from 600° C. to 550° C.;

thereafter, isothermally holding in a molten salt tank 1 at 400° C. to 600° C. and a successive molten salt tank 2 at 500° C. to 600° C. for 5 seconds to 150 seconds each;

subsequently cooling; and thereafter, performing wire drawing at a total reduction of area of 15% to 80%.

$$F1=C\ (\%)+Si\ (\%)/24+Mn\ (\%)/6 \quad (1)$$

[7]

A non-heat treated component whose tensile strength is 900 MPa to 1300 MPa, manufactured by cold-working a steel wire containing, in mass %: C: 0.20% to 0.50%, Si: 0.05% to 2.0%, Mn: 0.20% to 1.0%, being limited to contain P: 0.030% or less, S: 0.030% or less, N: 0.005% or less, F1 defined by the following expression (1) is less than 0.60, with the balance made up of Fe and inevitable impurities, wherein a metal structure contains a pearlite structure of 64×(C %)+52% or more in a volume fraction, with the balance made up of one kind or two kinds of a pro-eutectoid ferrite structure and a bainite structure, an average block grain diameter of the pearlite structure at a region from a surface layer to 0.1 D is 15 μm or less when a diameter of the steel wire is set to be D, and (the average block grain diameter of the pearlite structure at the region from the surface layer to 0.1 D)/(an average block grain diameter of the pearlite structure at a range from 0.25 D to a center) is less than 1.0, and an area ratio of a structure made up of a pearlite block whose aspect ratio is 2.0 or more is 70% or more relative to a whole pearlite structure at a region from a surface layer to 1.0 mm at a cross section in parallel to an axial direction of the steel wire.

$$F1=C\ (\%)+Si\ (\%)/24+Mn\ (\%)/6 \quad (1)$$

[8]

The non-heat treated component according to [7], further contains in mass %:

one kind or two or more kinds from among Al: 0.003% to 0.050%, Ca: 0.001% to 0.010%, Mg: 0.001% to 0.010%, Zr: 0.001% to 0.010%.

[9]

A manufacturing method of a non-heat treated component whose tensile strength is 900 MPa to 1300 MPa, includes:

heating a steel billet containing in mass %, C: 0.20% to 0.50%, Si: 0.05% to 2.0%, Mn: 0.20% to 1.0%, being limited to contain P: 0.030% or less, S: 0.030% or less, N: 0.005% or less, F1 defined by the following expression (1) is less than 0.60, with the balance made up of Fe and inevitable impurities;

hot-rolling into a wire material shape;

coiling at a coiling temperature of 800° C. to 900° C.;

cooling at a cooling rate of 20° C./s to 100° C./s from a coiling finish temperature to 600° C., further cooling at the cooling rate of 20° C./s or less from 600° C. to 550° C.;

thereafter, isothermally holding in a molten salt tank 1 at 400° C. to 600° C. and a successive molten salt tank 2 at 500° C. to 600° C. for 5 seconds to 150 seconds each;

subsequently cooling;

thereafter, performing wire drawing at a total reduction of area of 15% to 80%; and further, performing cold-working.

$$F1=C(\%)+Si(\%)/24+Mn(\%)/6 \quad (1)$$

[20]

The manufacturing method of the non-heat treated component according to [9], wherein after the wire drawing is performed, cold-working is performed without performing a softening heat treatment.

[21]

The manufacturing method of the non-heat treated component according to [9], further includes:

holding at 200° C. to 600° C. for 10 minutes or more after the cold-working is performed.

Effect of the Invention

According to the present invention, it is possible to provide a high-strength machine component having a tensile-strength of 900 MPa to 1300 MPa contributing to reduction in weight and size of a vehicle, various kinds of industrial machineries, and architectural members at low-cost.

BRIEF DESCRIPTION OF THE DRAWINGS

FIG. 1 is a view illustrating a relationship between a tensile strength (TS) and a ratio between an average block grain diameter of a pearlite structure within a range from a surface layer to 0.1 D and an internal average block grain diameter.

MODE FOR CARRYING OUT THE INVENTION

The present inventors investigated in detail about the relationship between the chemical composition and the structure of the steel material to obtain the high-strength machine component having the tensile strength of 900 MPa or more capable of performing cold forging even if the softening heat treatment is not performed as stated above and without performing a thermal refining process such as the quench-hardening and tempering. Then, the present inventors continued a total study as for a series of manufacturing method relating to an inline heat treatment using a retained heat at a hot-rolling time of a wire material, and up to a subsequent steel wire, machine component based on the metallurgical knowledge obtained by the investigation to manufacture the high-strength machine component at low cost and come to the following conclusions.

(x) To supply the high-strength to a wire material by wire drawing and cold forging, it is effective to change a steel structure into a pearlite structure excellent in a work hardening ability, but workability is low, a deformation resistance is high, and working cracks are easy to occur in the pearlite structure.

(y) To improve the workability of the pearlite structure, it is effective (y1) to reduce an amount of alloying elements, and (y2) to make a block grain diameter of the pearlite structure at a surface layer minute.

(z) Namely, it is possible to extremely improve cold workability of the pearlite structure if C (%)+Si (%)/24+Mn (%)/6 is set to be less than 0.60, and the grain diameter of the pearlite block at a region from the surface layer to 0.1 D (D: a diameter of the wire material) is set to be 15 μm or less, and a ratio with a grain diameter of a pearlite block at inside of the wire material is set to be less than 1.0.

As stated above, it becomes possible to secure the excellent work hardening ability, maintain the high-strength even if the quench-hardening and tempering process is not performed, and improve the cold forgeability by improving the chemical composition and the structure of the steel material.

A steel wire to be a material to obtain the machine component capable of performing the cold forging even if the softening heat treatment is not performed, and being high-strength without performing the thermal refining process such as the quench-hardening and tempering is one already having a microstructure with the above-stated characteristics at a stage of the steel wire, and it is effective to work into a component for machine structural use without performing the heat treatment before the working.

In this case, the cold workability is deteriorated but a soften annealing cost and a quench-hardening and tempering cost after the work can be reduced, and therefore, the present invention is advantageous in cost compared to a conventional manufacturing method in which the spheroidizing annealing is performed for softening.

Further, as for a manufacturing method of the wire material to be a material of the steel wire, it is possible to obtain the steel material in almost perfect pearlite structure without adding any expensive alloying elements if it is immersed in a molten salt bath made up of two tanks just after rolling while using remaining heat at the hot-rolling time. This manufacturing method is the best manufacturing method capable of obtaining excellent material characteristics at low cost.

Namely, the present invention is a series of manufacturing method in which the steel material whose chemical composition is adjusted to be the pearlite structure is immersed in the molten salt bath by using the remaining heat at the hot-rolling time to obtain the wire material having the almost perfect pearlite structure, then wire drawing is performed at a room temperature under a specific condition, an adjustment is performed to be high-strength pearlite structure, it is formed into a machine component, and thereafter, heat treatment at a relatively low temperature is performed to recover ductility thereof.

Therefore, according to the present invention, it is possible to manufacture the machine component whose tensile strength is 900 MPa to 1300 MPa at low cost though it is extremely difficult to manufacture it according to the conventional manufacturing method and knowledge.

At first, reasons for limiting the chemical composition of the steel material (wire material, steel wire, non-heat treated component) of the present invention are described. Hereinafter, a symbol "%" relating to the chemical composition means mass %.

C is added to secure a predetermined tensile strength. When it is less than 0.20%, it is difficult to secure the tensile strength of 900 MPa or more, on the other hand, when it exceeds 0.50%, cold forgeability deteriorates, and therefore, C is set to be 0.20% to 0.50%. A preferable range to enable both the strength and the cold forgeability is 0.35% to 0.48%.

Si functions as a deoxidizing element and has an effect enhancing the tensile strength by solid-solution strengthening. When it is less than 0.05%, an addition effect is insufficient. When it exceeds 2.0%, the addition effect is saturated, hot ductility deteriorates, flaws are easy to occur, and manufacturability is lowered. Accordingly, Si is set to be 0.05% to 2.0%. A preferable range in consideration of the manufacturability is 0.18% to 0.5%.

Mn has an effect enhancing the tensile strength of the steel after a pearlite transformation. When it is less than 0.20%, an addition effect is insufficient, and when it exceeds 1.0%, the addition effect is saturated, and therefore, a range of Mn is set to be 0.20% to 1.0%. A more preferable range is 0.50% to 0.8%.

P and S are inevitable impurities. These elements segregate at a grain boundary to deteriorate hydrogen embrittlement resistant characteristics, and therefore, the less it is, the better. Accordingly, an upper limit is each set at 0.030%. It is preferably 0.015% or less. A lower limit includes "0" (zero) %, but both P and S are inevitably mixed for at least approximately 0.0005%.

N deteriorates the cold workability by dynamic strain aging, and therefore, the less it is, the better, so an upper limit is set at 0.005%. It is preferably 0.004% or less. A lower limit includes "0" (zero) %, but it is inevitably mixed for at least approximately 0.0005%.

When a relational expression (1) of contents of C, Si, and Mn: F1=C (%)+Si (%)/24+Mn (%)/6 becomes 0.60 or more, a deformation resistance increases and the cold workability deteriorates, and therefore, F1 is set to be less than 0.60.

C, Si, and Mn are elements improving the strength. F1 is an expression restricting a total amount of C, Si, and Mn in consideration of a degree of contribution to the strength improvement.

In the present invention, Al may be contained for 0.003% to 0.050%. Al functions as the deoxidizing element, and in addition, forms AlN to reduce solid-solution N, and suppresses the dynamic strain aging. AlN functions as a pinning particle to refine crystal grains and improves the cold workability.

When it is less than 0.003%, there is no addition effect, and when it exceeds 0.050%, the addition effect is saturated, and the manufacturability deteriorates, and therefore, Al is set to be 0.003% to 0.050%. It is preferably 0.008% to 0.045%.

In the present invention, one kind or two more more kinds may be contained from among Ca: 0.001% to 0.010%, Mg: 0.001% to 0.010%, Zr: 0.001% to 0.010% as the deoxidizing elements. These elements function as the deoxidizing elements, and form sulfide such as CaS, MgS to fix solid-solution S and has an effect improving hydrogen embrittlement resistant characteristics.

Cr, Mo, Ni, Ti, Nb and V enhance the strength, deteriorate the cold workability, and therefore, they are necessary to be reduced. Note that when an amount contained as the impurities is less than 0.60 in a value of C (%)+Si (%)/24+Mn (%)/6+(Cr (%)+Mo (%))/5+Ni (%)/40+(Ti (%)+Nb (%)+V (%))/5, an effect on the cold workability is small, and therefore, Cr, Mo, Ni, Ti, Nb and V are allowed within a range of less than 0.60 in the above-stated value. The above-stated value is preferably 0.58 or less.

Note that O inevitably exists in a mode of an oxide of Al, Ca and/or Mg in the steel. When an O amount is large, coarse oxide may be generated, and it may cause a fatigue fracture, and therefore, it is preferably 0.01% or less. Note that O is inevitably mixed for at least approximately 0.001%.

In the present invention, a steel billet having the above-stated chemical composition is necessary to be hot-rolled to change it into a steel material (wire material, steel wire, non-heat treated component) having a specific microstructure. Next, limitation reasons of the microstructure of the steel material (wire material, steel wire, non-heat treated component) are described.

The pearlite structure is a structure having excellent work hardening characteristics. When a volume fraction is less than "64×(C %)+52%", work hardening at the wire drawing time and the cold forging time becomes small, the strength is lowered, and working cracks are easy to occur at the cold forging time because a non-pearlite structure part becomes a starting point of the fracture. Accordingly, a lower limit of the volume fraction of the pearlite structure is set to be "64×(C %)+52%".

It is possible to contain a pro-eutectoid ferrite structure and a bainite structure as a remaining structure other than the pearlite structure. A martensite structure is not contained because the cracks at the wire drawing time and the cold forging time are easy to occur and the hydrogen embrittlement resistant characteristics are deteriorated.

The volume fraction of the pearlite structure is found, for example, by photographing a C-cross section of the wire material (a cross section perpendicular to a longitudinal direction of the wire material) at a magnification of 1000 times by using a scanning electron microscope, and by performing image analysis. For example, at the C-cross section of the wire material, a region of 125 μm×95 μm is photographed at each of a region in a vicinity of a surface layer (surface) of the wire material, a ¼ D part (a part kept off for ¼ of a diameter D of the wire material from the surface of the wire material in a center direction of the wire material), and a ½ D part (a center part of the wire material). An area ratio of a structure contained in a microscopic observation surface (C-cross section) is equal to the volume fraction of the structure, and therefore, the area ratio obtained by the image analysis is the volume fraction of the structure. Note that the volume fractions of the pearlite structures of the steel wire and the non-heat treated component are similarly defined.

When an average block grain diameter of the pearlite structure at a range from the surface layer to 0.1 D exceeds 15 μm, the working cracks are easy to occur at the cold forging time, and therefore, an upper limit of the average block grain diameter is set to be 15 μm.

When (the average block grain diameter of the pearlite structure at the region from the surface layer to 0.1 D)/(an average block grain diameter of the pearlite structure at a range from 0.25 D to the center) becomes 1.0 or more, the working cracks are easy to occur, and therefore, a ratio of the average block grain diameters is set to be less than 1.0. A preferable upper limit thereof is 0.90.

Next, in the present invention, an area ratio of a structure made up of a pearlite block whose aspect ratio is 2.0 or more at a region from a surface layer to 1.0 mm at a cross section which is in parallel to an axial direction of the steel wire is 70% or more relative to a whole pearlite structure at the steel wire obtained by wire drawing the wire material. A relationship between a tensile strength (TS) and a ratio of the average block grain diameter of the pearlite structure at the range from the surface layer to 0.1 D and an internal average block grain diameter is illustrated in FIG. 1. In the drawing, a black square represents a case of a steel material whose chemical composition is out of a range of the present invention, and F1 is 0.6 or more.

In the drawing, a black triangle represents a case of a steel wire whose chemical composition is within the range of the present invention, but whose volume fraction of the structure made up of the pearlite block whose aspect ratio is 2.0 or more is less than 70% relative to the whole pearlite structure to be out of the range of the present invention, and ♦ represents a case of a steel wire whose chemical composition is within the range of the present invention, and whose volume fraction of the structure made up of the pearlite block whose aspect ratio is 2.0 or more is 70% or more relative to the whole pearlite structure.

The average block grain diameter can be measured by using, for example, an EBSP (Electron Back Scattering Pattern) device. Specifically, a region of 275 μm×165 μm is measured at each of the range from the surface layer to 0.1 D and a range from the ¼ D part (a part kept off for ¼ of the diameter D of a steel wire from the surface of the steel wire in a center direction of the steel wire) to the ½ D part (the center part of the steel wire) at the wire material cross section perpendicular to the longitudinal direction of the wire material.

A boundary where a misorientation becomes 10° or more from a crystal orientation map of a bee structure measured by the EBSP device is set to be a block grain boundary. A circle-equivalent grain diameter of one block grain is defined as a block grain diameter, and a volume average thereof is defined as an average grain diameter.

The non-heat treated component is a machine component in which the heat treatments such as the soften annealing and the quench-hardening and tempering process are not performed, and the strength is supplied by working effects such as the wire drawing and the forging. Here, it is the machine component whose reduction of area from an initial cross section is 10% or more.

Next, a manufacturing method of the steel material (the wire material, the steel wire, the non-heat treated component) is described. A steel billet made up of a predetermined chemical composition is heated, then hot-rolled into a wire state, and thereafter, it is coiled up in a ring state. A coiling temperature is set at 800° C. to 900° C., and it is cooled at a cooling rate of 20° C./sec to 100° C./sec from a coiling finish temperature to 600° C., further it is cooled at a cooling rate of 20° C./sec or less from 600° C. to 550° C.

The coiling temperature affects on the pearlite block grain after transformation. When the coiling temperature exceeds 900° C., the pearlite block grain diameter of the wire material after the hot-rolling becomes a coarse grain to exceed 15 μm at a surface layer part, and the cold forgeability is deteriorated. When the coiling temperature is less than 800° C., the volume fraction of the pro-eutectoid ferrite of the structure after transformation increases, and the volume fraction of the pearlite structure becomes less than "64×(C %)+52%". Accordingly, the coiling temperature is set at 800° C. to 900° C.

When the cooling rate after the coiling is less than 20° C./sec, the volume fraction of the pro-eutectoid ferrite structure of the wire material increases and the volume fraction of the pearlite structure becomes less than "64×(C %)+52%". An excessive cooling equipment is required to enable the cooling rate of over 100° C./sec. Accordingly, the cooling rate after the coiling to 600° C. is set at 20° C./sec to 100° C./sec.

When the cooling rate from 600° C. to 550° C. exceeds 20° C./sec, the bainite structure is generated in the structure to deteriorate the cold forgeability, and therefore, an upper limit of the cooling rate from 600° C. to 550° C. is set at 20° C./sec. A lower limit is preferably 1° C./sec from a point of view of productivity.

Next, the wire material is immersed in the molten salt tank by using the remaining heat at the hot-rolling time to generate an isothermal pearlite transformation.

After it is cooled to 550° C., the wire material is immersed into a molten salt tank 1 at 400° C. to 600° C. and a successive molten salt tank 2 at 500° C. to 600° C., and it is isothermally held for 5 seconds to 150 seconds respectively, and thereafter, it is cooled to manufacture the wire material having the above-stated microstructure.

When the temperature of the molten salt tank 1 is less than 400° C., bainite is generated to deteriorate the cold forgeability. When the temperature of the molten salt tank 1 exceeds 600° C., a time required for the pearlite transformation becomes long. Accordingly, the temperature of the molten salt tank 1 is set at 400° C. to 600° C.

At the molten salt tank 2 subsequent to the molten salt tank 1, the temperature is set at 500° C. to 600° C. to finish the pearlite transformation within a minimum time. An immersion time to the molten salt tank is set to be 5 seconds to 150 seconds at each tank from points of view of enough temperature keeping and the productivity of the steel material. The cooling after it is held in the molten salt tank for a predetermined time may be a water cooling or a standing-to-cool.

Note that the similar effect can be obtained by using equipments such as a lead tank and a fluidized bed as the immersion tank instead of the molten salt tank, but the present invention is superior in points of environment and manufacturing cost.

To change the wire material manufactured as stated above into a steel wire having the desired strength and cold forgeability by performing the wire drawing, a mode of the pearlite structure at a region from the surface layer to 1.0 mm is important.

When the volume fraction of the structure made up of the pearlite block whose aspect ratio is 2.0 or more is less than 70% relative to the whole pearlite structure at the region from the surface layer to 1.0 mm of the steel wire, the improvement effect of the cold forgeability is not obtained. Accordingly, a lower limit of the volume fraction of the structure made up of the pearlite block whose aspect ratio is 2.0 or more is set at 70%. A preferable lower limit of the volume fraction of the structure is 80% because the less the volume fraction of the block whose aspect ratio is less than 2.0 is, the better.

When the aspect ratio of the pearlite block is less than 2.0, the improvement effect of the cold forgeability is small, and therefore, a lower limit of the aspect ratio is set at 2.0. Note that the aspect ratio is a ratio between a major axis and a minor axis of a block grain, and it is equal to a ratio between a diameter in an axial direction and a diameter in a perpendicular direction to the axis after the wire drawing (the diameter in the axial direction/the diameter in the perpendicular direction to the axis).

In the wire drawing, the reduction of area is set at 15% to 80%. When the reduction of area of the wire drawing is less than 15%, the work hardening is insufficient and the strength is in short, and therefore, a lower limit of the reduction of area is set at 15%. When the reduction of area exceeds 80%, the working cracks are easy to occur at the cold forging time, and therefore, an upper limit of the reduction of area is set at 80%. A preferable reduction of area is 20% to 65%. Note that the wire drawing may be performed once or plural times.

The steel wire obtained as stated above is shaped into a final machine component, but a heat treatment is not necessarily performed before the shaping to maintain the above-stated characteristics of the microstructure. The steel wire obtained as stated above is cold forged (cold working), and thereby, a non-heat treated component whose tensile strength is 900 MPa to 1300 MPa is obtained. A foundation of the present invention is to obtain the non-heat treated component whose tensile strength is 900 MPa or more. When the strength as a component is less than 900 MPa in the tensile strength, it is not necessary to apply the present invention. On the other hand, a component exceeding 1300 MPa is difficult to manufacture by the cold forging, and the manufacturing cost increases. Accordingly, the tensile strength is set to be 900 MPa to 1300 MPa as the component strength.

The tensile strength is preferably 900 MPa to 1250 MPa, more preferably 900 MPa to less than 1200 MPa. The machine component may be held at 200° C. to 600° C. for 10 minutes to 5 hours after it is cold forged into the component shape, and thereafter, cooled so as to improve other material characteristics required as the machine component such as a yield strength, a yield ratio, or ductility though it is high-strength as it is as the machine component.

EXAMPLES

Next, examples of the present invention are described. Conditions in the examples are an conditional example applied to verify feasibility and effects of the present invention, and the present invention is not limited to the conditional example. The present invention is able to apply various conditions within a range not departing from the spirit of the invention and attaining an object of the invention.

Chemical compositions of the steel materials supplied for the example and values of the expression F1=(C %)+(Si %)/24+(Mn %)/6 are represented in Table 1. Steel types L, M, N and O are comparative examples out of the range of the present invention.

[Table 1]

Steel billets made up of these steel types are hot-rolled into wire materials each having the wire diameter of 8.0 mm to 15.0 mm. After the hot-rolling, coiling, cooling are performed, and the isothermal transformation process is performed at the molten salt tanks 1, 2 on a rolling line, and then cooled.

A wire diameter of each of the hot-rolled wire materials, a coiling temperature after the hot-rolling, a cooling rate from the coiling temperature to 600° C., a cooling rate from 600° C. to 550° C., an isothermal holding temperature and an isothermal holding time at each of the molten salt tanks 1, 2 are represented in Table 2. The wire drawing is performed for each of the hot-rolled wire materials after the cooling with the reduction of areas represented in Table 2, and a heat treatment is performed. Respective heat treatment temperatures and holding times of the heat treatment are represented in Table 2.

[Table 2]

A metal structure, a volume fraction of a pearlite structure, an average block grain diameter of the pearlite structure at a region from a surface layer to 0.1 D, an average block grain diameter of an internal pearlite structure (an average block grain diameter of the pearlite structure at a range from 0.25 D to a center), and a ratio of the average block grain diameters between the surface layer and the internal of each of the wire materials obtained by performing the isothermal transformation process at the molten salt tanks 1, 2 and then cooled are represented in Table 3. Note that in the metal structure, F represents a pro-eutectoid ferrite, P represents pearlite, B represents bainite, and M represents martensite.

[Table 3]

Structures of the steel wires after the wire drawing are the same as the structures represented in Table 3. In Table 3, each ratio of a structure made up of a pearlite block whose aspect ratio is 2.0 or more relative to a whole pearlite structure at a region from a surface layer to 1.0 mm at a cross section in parallel to an axial direction of the steel wire is represented. Besides, each lower limit of the volume fraction of the pearlite structure calculated by "64×(C %)+52%" is represented in Table. 3.

Each tensile strength at a final machine component obtained by performing the cold-forging (cold working) of the steel wire, and each cold forgeability of the steel wire before the heat treatment are represented in Table 4.

[Table 4]

The tensile strength is evaluated by using a 9A test piece of JIS Z 2201 and performing a tensile test based on a test method of JIS Z 2241. The cold forgeability is evaluated by a maximum stress (deformation resistance) and a maximum compression ratio (limit compression ratio) without any cracks by using a sample of ϕ5.0 mm×7.5 mm prepared by machining the steel wire after the wire drawing, when an end face of the sample is constrained and compressed with a metal mold having a groove in a concentric state, and machined at a compression ratio of 57.3% corresponding to a distortion of 1.0.

When the maximum stress when it is machined at the compression ratio of 57.3% is 1200 MPa or less, it is judged that the deformation resistance is excellent, and when the maximum compression ratio without any cracks is 65% or more, it is judged that the limit compression ratio is excellent.

A level 10 is a conventional manufacturing method in which the isothermal transformation process is not performed after the coiling, and it is cooled on Stelmor as represented in Table 2, and the volume fraction of the pearlite structure is out of the range of the present invention.

A level 11 is a comparative example in which the wire material of the level 10 manufactured by cooling on the Stelmor is heated at 950° C. for 10 minutes, and held in a lead bath at 580° C. for 100 seconds. The average block grain diameter of the pearlite structure at the range from the surface layer to 0.1 D, and the ratio of the average block grain diameters between the surface layer and the internal are out of the range of the present invention.

A level 13 is an example in which the coiling temperature exceeds the upper limit of the present invention. The average block grain diameter of the pearlite structure at the range from the surface layer to 0.1 D, and the ratio of the average block grain diameters of the surface layer and the internal are out of the range of the present invention.

A level 15 is an example in which the wire drawing reduction of area is smaller than the lower limit of the range of the present invention, and the volume fraction of the pearlite structure whose aspect ratio is 2.0 or more does not reach the lower limit of the range of the present invention.

A level 16 is an example in which the temperature of the molten salt bath is lower than the lower limit of the range of the present invention, and the martensite structure is mixed in the metal structure to be out of the structure of the present invention, in addition, the volume fraction of the pearlite structure and the volume fraction of the pearlite structure whose aspect ratio is 2.0 or more do not reach the lower limit of the range of the present invention. In the level 16 in which the martensite structure is mixed, wire drawability deteriorates, and wire breakage occurred during the wire drawing.

A level 22 is an example in which the coiling temperature is less than the lower limit of the range of the present invention. The pro-eutectoid ferrite is generated, and the volume fraction of the pearlite structure is less than the lower limit of the range of the present invention.

A level 23 is an example in which the temperature of the molten salt bath 1 exceeds the upper limit of the range of the present invention. The martensite structure is mixed in the metal structure to be out of the structure of the present invention, in addition, the volume fraction of the pearlite structure is less than the lower limit of the range of the present invention.

A level 24 is an example in which the temperature of the molten salt bath 2 exceeds the upper limit of the range of the present invention. The martensite structure is mixed in the metal structure to be out of the structure of the present invention, in addition, the volume fraction of the pearlite structure and the volume fraction of the pearlite structure whose aspect ratio is 2.0 or more do not reach the lower limit of the range of the present invention.

A level 25 is an example in which the holding times of the molten salt tank 1 and the molten salt tank 2 are less than the lower limit of the range of the present invention. The martensite structure is mixed in the metal structure to be out of the structure of the present invention, in addition, the volume fraction of the pearlite structure and the volume fraction of the pearlite structure whose aspect ratio is 2.0 or more do not reach the lower limit of the range of the present invention. In the level 25 in which the martensite structure is mixed, the wire drawability deteriorates, and wire breakage occurred during the wire drawing.

Mechanical properties of respective levels are represented in Table 4.

All of the limit compression ratios are less than 65% and bad in the level 10 in which the volume fraction of the pearlite structure and the ratio of the average block grain diameters between the surface layer and the internal are out of the range of the present invention, the level 11 in which the average block grain diameter of the pearlite structure at the range from the surface layer to 0.1 D and the ratio the ratio of the average block grain diameters between the surface layer and the internal are out of the range of the present invention, the level 13 in which the average block grain diameter of the pearlite structure at the range from the surface layer to 0.1 D is out of the range of the present invention, the level 15 in which the ratio of the average block grain diameters between the surface layer and the internal is out of the range of the present invention, each of the level 16 and level 24 in which the martensite structure is mixed in the metal structure to be out of the structure of the present invention and the volume fraction of the pearlite structure and the the volume fraction of the pearlite structure whose aspect ratio is 2.0 or more are out of the range of the present invention, the level 18 in which the volume fraction of the pearlite structure and the the volume fraction of the pearlite structure whose aspect ratio is 2.0 or more are out of the range of the present invention, the level 22 in which the volume fraction of the pearlite structure is out, and the level 23 in which the martensite structure is mixed in the metal structure to be out of the structure of the present invention, and the volume fraction of the pearlite structure is out of the range of the present invention.

In each of a level 19 using the steel type M in which Cr and Mo are out of the range of the present invention, a level 20 using the steel type N in which C and F1 are out of the range of the present invention, and a level 21 using the steel type 0 in which C and N are out of the range of the present invention, the stress at the compression ratio of 57.3% exceeds 1200 MPa, and the deformation resistance is bad.

It can be seen from the above-stated description that the machine component according to the present invention has workability in which the cold forging is possible even if the soften annealing is not performed, and has the strength of 900 MPa to 1300 MPa even if the quench-hardening and tempering process is not performed.

INDUSTRIAL APPLICABILITY

As stated above, according to the present invention, it is possible to provide the high-strength machine component contributing to reduction in weight and size of a vehicle, various kinds of industrial machineries, and architectural members at low-cost. Accordingly, the present invention is applicable for mechanical industries.

TABLE 1

| STEEL TYPE | C | Si | Mn | P | S | N | Al | Ca | Mg | Zr | Cr | Mo | F1 | REMARKS |
|---|---|---|---|---|---|---|---|---|---|---|---|---|---|---|
| A | 0.24 | 0.08 | 0.64 | 0.009 | 0.011 | 0.0026 | 0.041 | | | | | | 0.35 | |
| B | 0.32 | 0.21 | 0.66 | 0.008 | 0.006 | 0.0033 | 0.042 | | | | | | 0.44 | |
| C | 0.34 | 0.23 | 0.74 | 0.011 | 0.007 | 0.0028 | | | 0.0018 | | | | 0.47 | |
| D | 0.36 | 0.09 | 0.92 | 0.015 | 0.012 | 0.0036 | 0.032 | | | 0.0024 | | | 0.52 | |
| E | 0.37 | 0.23 | 0.66 | 0.014 | 0.006 | 0.0034 | 0.03 | | | | | | 0.49 | |
| F | 0.38 | 1.82 | 0.38 | 0.013 | 0.024 | 0.0037 | 0.004 | 0.0021 | | | | | 0.52 | |
| G | 0.41 | 0.32 | 0.74 | 0.009 | 0.007 | 0.0030 | 0.024 | | | | | | 0.55 | |
| H | 0.44 | 0.22 | 0.64 | 0.013 | 0.019 | 0.0036 | 0.02 | | | | | | 0.56 | |
| I | 0.46 | 0.12 | 0.71 | 0.008 | 0.011 | 0.0029 | 0.027 | | | | | | 0.58 | |
| J | 0.48 | 0.11 | 0.62 | 0.014 | 0.008 | 0.0034 | 0.033 | | | | | | 0.59 | |
| K | 0.49 | 0.06 | 0.61 | 0.012 | 0.009 | 0.0037 | 0.025 | 0.0014 | 0.0021 | | | | 0.59 | |
| L | 0.17 | 0.26 | 0.63 | 0.007 | 0.014 | 0.0048 | 0.042 | | | | | | 0.29 | COMPARATIVE EXAMPLE |
| M | 0.48 | 0.06 | 0.64 | 0.014 | 0.007 | 0.0037 | 0.032 | | | | 0.23 | 0.14 | 0.59 | COMPARATIVE EXAMPLE |
| N | 0.55 | 0.18 | 0.73 | 0.013 | 0.011 | 0.0043 | 0.038 | | | | | | 0.68 | COMPARATIVE EXAMPLE |
| O | 0.57 | 0.06 | 0.13 | 0.009 | 0.026 | 0.0061 | 0.035 | | | | | | 0.59 | COMPARATIVE EXAMPLE |

TABLE 2

| LEVEL | STEEL TYPE | WIRE DIAMETER (mm) | COILING TEMPERATURE (° C.) | COOLING RATE FROM COILING TO 600° C. (° C./s) | COOLING RATE FROM 600° C. TO 550° C. (° C./s) | TEMPERATURE OF MOLTEN SALT TANK 1 (° C.) | HOLDING TIME OF MOLTEN SALT TANK 1 (s) |
|---|---|---|---|---|---|---|---|
| 1 | A | 15.0 | 820 | 30 | 7 | 450 | 30 |
| 2 | B | 8.0 | 850 | 65 | 18 | 550 | 20 |
| 3 | C | 14.5 | 840 | 40 | 9 | 510 | 25 |
| 4 | D | 14.5 | 840 | 40 | 9 | 510 | 25 |
| 5 | E | 15.0 | 825 | 30 | 7 | 470 | 30 |
| 6 | E | 15.0 | 825 | 30 | 7 | 470 | 30 |
| 7 | F | 14.0 | 865 | 35 | 9 | 490 | 35 |
| 8 | G | 14.0 | 865 | 35 | 9 | 490 | 35 |
| 9 | H | 15.0 | 825 | 35 | 8 | 470 | 30 |
| 10 | H | 15.0 | 825 | 1.5 | AIR BLAST COOLING AFTER COILING | | |
| 11 | H | 15.0 | | BATCH LP OF LEVEL 10 | | | |
| 12 | I | 10.5 | 845 | 50 | 14 | 480 | 20 |
| 13 | I | 10.5 | 940 | 55 | 14 | 480 | 20 |
| 14 | J | 15.0 | 810 | 35 | 9 | 460 | 30 |
| 15 | J | 15.0 | 810 | 35 | 9 | 460 | 30 |
| 16 | J | 15.0 | 810 | 40 | 23 | 320 | 30 |
| 17 | K | 8.0 | 885 | 75 | 18 | 550 | 20 |
| 18 | L | 14.5 | 850 | 40 | 9 | 520 | 25 |
| 19 | M | 14.5 | 850 | 40 | 9 | 520 | 25 |
| 20 | N | 14.5 | 850 | 40 | 9 | 520 | 25 |
| 21 | O | 14.5 | 850 | 40 | 9 | 520 | 25 |
| 22 | I | 10.5 | 750 | 45 | 14 | 480 | 20 |
| 23 | K | 8.0 | 885 | — | — | 650 | 20 |
| 24 | K | 8.0 | 885 | 75 | 18 | 550 | 20 |
| 25 | K | 8.0 | 885 | 75 | 18 | 550 | 3 |

| LEVEL | TEMPERATURE OF MOLTON SALT TANK 2 (° C.) | HOLDING TIME OF MOLTON SALT TANK 2 (s) | WIRE DRAWING REDUCTION OF AREA (%) | HEAT TREATMENT TEMPERATURE (° C.) | HOLDING TIME (h) | WIRE DRAWING CRACK | REMARKS |
|---|---|---|---|---|---|---|---|
| 1 | 560 | 55 | 77.1 | 200 | 1 | | EXAMPLE |
| 2 | 570 | 30 | 30.6 | 250 | 3 | | EXAMPLE |
| 3 | 540 | 45 | 56.4 | 200 | 1 | | EXAMPLE |
| 4 | 540 | 45 | 56.4 | 200 | 3 | | EXAMPLE |
| 5 | 550 | 55 | 26.6 | 250 | 3 | | EXAMPLE |
| 6 | 550 | 55 | 70.1 | 250 | 3 | | EXAMPLE |
| 7 | 560 | 60 | 53.1 | 300 | 1 | | EXAMPLE |
| 8 | 560 | 60 | 53.1 | 200 | 4 | | EXAMPLE |
| 9 | 550 | 55 | 58.2 | 250 | 3 | | EXAMPLE |
| 10 | AIR BLAST COOLING AFTER COILING | | 58.2 | 250 | 3 | | COMPARATIVE EXAMPLE |
| 11 | BATCH LP OF LEVEL 10 | | 58.2 | 250 | 3 | | COMPARATIVE EXAMPLE |
| 12 | 540 | 30 | 30.5 | 250 | 3 | | EXAMPLE |
| 13 | 540 | 30 | 30.5 | 250 | 3 | | COMPARATIVE EXAMPLE |
| 14 | 540 | 55 | 70.1 | 350 | 0.5 | | EXAMPLE |
| 15 | 540 | 55 | 9.2 | 250 | 3 | | COMPARATIVE EXAMPLE |
| 16 | 400 | 55 | — | — | — | WIRE BREAKAGE | COMPARATIVE EXAMPLE |
| 17 | 570 | 30 | 44.2 | 300 | 1 | | EXAMPLE |
| 18 | 550 | 45 | 56.4 | 250 | 3 | | COMPARATIVE EXAMPLE |
| 19 | 550 | 45 | 56.4 | 250 | 3 | | COMPARATIVE EXAMPLE |
| 20 | 550 | 45 | 56.4 | 250 | 3 | | COMPARATIVE EXAMPLE |
| 21 | 550 | 45 | 56.4 | 250 | 3 | | COMPARATIVE EXAMPLE |
| 22 | 540 | 30 | 30.5 | 250 | 3 | | COMPARATIVE EXAMPLE |
| 23 | 570 | 30 | 44.2 | 300 | 1 | | COMPARATIVE EXAMPLE |
| 24 | 650 | 30 | 44.2 | 300 | 1 | | COMPARATIVE EXAMPLE |
| 25 | 570 | 3 | — | — | — | WIRE BREAKAGE | COMPARATIVE EXAMPLE |

TABLE 3

| LEVEL | STEEL TYPE | METAL STRUCTURE | LOWER LIMIT OF VOLUME FRACTION OF PEARLITE (%) | VOLUME FRACTION OF PEARLITE (%) | AVERAGE BLOCK GRAIN DIAMETER OF PEARLITE FROM SURFACE LAYER TO 0.1 D (μm) | AVERAGE BLOCK GRAIN DIAMETER OF INTERNAL PEARLITE STRUCTURE (μm) | RATIO OF AVERAGE BLOCK GRAIN DIAMETER BETWEEN SURFACE LAYER AND INTERNAL | VOLUME FRACTION OF PEARLITE WHOSE ASPECT RATIO IS 2.0 OR MORE (%) | REMARKS |
|---|---|---|---|---|---|---|---|---|---|
| 1 | A | F, P, B | 67.4 | 69 | 10.3 | 12.6 | 0.82 | 77 | EXAMPLE |
| 2 | B | F, P, B | 72.5 | 76 | 9.7 | 12.4 | 0.78 | 72 | EXAMPLE |
| 3 | C | F, P, B | 73.8 | 78 | 10.6 | 13.5 | 0.79 | 74 | EXAMPLE |
| 4 | D | F, P, B | 75.0 | 78 | 11.7 | 12.8 | 0.91 | 76 | EXAMPLE |
| 5 | E | F, P, B | 75.7 | 80 | 11.8 | 14.6 | 0.81 | 73 | EXAMPLE |
| 6 | E | F, P, B | 75.7 | 80 | 11.8 | 14.6 | 0.81 | 82 | EXAMPLE |
| 7 | F | F, P, B | 76.3 | 78 | 10.9 | 12.9 | 0.84 | 76 | EXAMPLE |
| 8 | G | F, P, B | 78.2 | 82 | 11.2 | 13.4 | 0.84 | 74 | EXAMPLE |
| 9 | H | F, P, B | 80.2 | 86 | 10.8 | 12.3 | 0.88 | 76 | EXAMPLE |
| 10 | H | F, P | 80.2 | 68 | 11.8 | 11.6 | 1.02 | 71 | COMPARATIVE EXAMPLE |
| 11 | H | F, P | 80.2 | 88 | 19.7 | 17.4 | 1.13 | 77 | COMPARATIVE EXAMPLE |
| 12 | I | F, P, B | 81.4 | 88 | 11.1 | 13.8 | 0.80 | 73 | EXAMPLE |
| 13 | I | F, P, B | 81.4 | 88 | 17.2 | 16.9 | 1.02 | 75 | COMPARATIVE EXAMPLE |
| 14 | J | F, P, B | 82.7 | 88 | 12.3 | 14.2 | 0.87 | 84 | EXAMPLE |
| 15 | J | F, P, B | 82.7 | 88 | 12.3 | 14.2 | 0.87 | 63 | COMPARATIVE EXAMPLE |
| 16 | J | F, P, B, M | 82.7 | 43 | 10.6 | 12.7 | 0.83 | 62 | COMPARATIVE EXAMPLE |
| 17 | K | F, P, B | 83.4 | 90 | 10.7 | 13.6 | 0.79 | 76 | EXAMPLE |
| 18 | L | F, P, B | 62.9 | 54 | 11.7 | 10.6 | 1.10 | 62 | COMPARATIVE EXAMPLE |
| 19 | M | F, P, B | 82.7 | 90 | 12.2 | 13.9 | 0.88 | 74 | COMPARATIVE EXAMPLE |
| 20 | N | F, P, B | 87.2 | 94 | 13.5 | 14.8 | 0.91 | 76 | COMPARATIVE EXAMPLE |
| 21 | O | F, P, B | 88.5 | 95 | 14.2 | 15.3 | 0.93 | 75 | COMPARATIVE EXAMPLE |
| 22 | I | F, P, B | 81.4 | 71 | 10.3 | 12.9 | 0.80 | 70 | COMPARATIVE EXAMPLE |
| 23 | K | F, P, B, M | 83.4 | 72 | 14.8 | 15.2 | 0.97 | 72 | COMPARATIVE EXAMPLE |
| 24 | K | F, P, B, M | 83.4 | 69 | 10.9 | 13.2 | 0.83 | 67 | COMPARATIVE EXAMPLE |
| 25 | K | F, P, B, M | 83.4 | 39 | 12.3 | 13.8 | 0.89 | 54 | COMPARATIVE EXAMPLE |

TABLE 4

| LEVEL | STEEL TYPE | TENSILE STRENGHT (MPa) | DEFORMATION RESISTANCE (MPa) | LIMIT COMPRESSION RATIO (%) | EVALUATION | | REMARKS |
|---|---|---|---|---|---|---|---|
| | | | | | DEFORMATION RESISTANCE | LIMIT COMPRESSION RATIO | |
| 1 | A | 1018 | 893 | 80 OR MORE | GOOD | GOOD | EXAMPLE |
| 2 | B | 917 | 945 | 80 OR MORE | GOOD | GOOD | EXAMPLE |
| 3 | C | 1026 | 1008 | 80 OR MORE | GOOD | GOOD | EXAMPLE |
| 4 | D | 1091 | 1017 | 76 | GOOD | GOOD | EXAMPLE |
| 5 | E | 1156 | 1047 | 72 | GOOD | GOOD | EXAMPLE |
| 6 | E | 1214 | 1089 | 72 | GOOD | GOOD | EXAMPLE |
| 7 | F | 1233 | 1112 | 70 | GOOD | GOOD | EXAMPLE |
| 8 | G | 1128 | 1064 | 72 | GOOD | GOOD | EXAMPLE |
| 9 | H | 1179 | 1082 | 70 | GOOD | GOOD | EXAMPLE |
| 10 | H | 1070 | 1074 | 58 | GOOD | BAD | COMPARATIVE EXAMPLE |
| 11 | H | 1185 | 1098 | 64 | GOOD | BAD | COMPARATIVE EXAMPLE |
| 12 | I | 1038 | 1108 | 72 | GOOD | GOOD | EXAMPLE |
| 13 | I | 1046 | 1112 | 62 | GOOD | BAD | COMPARATIVE EXAMPLE |

TABLE 4-continued

| LEVEL | STEEL TYPE | TENSILE STRENGHT (MPa) | DEFORMATION RESISTANCE (MPa) | LIMIT COMPRESSION RATIO (%) | EVALUATION DEFORMATION RESISTANCE | EVALUATION LIMIT COMPRESSION RATIO | REMARKS |
|---|---|---|---|---|---|---|---|
| 14 | J | 1267 | 1130 | 70 | GOOD | GOOD | EXAMPLE |
| 15 | J | 1008 | 1110 | 63 | GOOD | BAD | COMPARATIVE EXAMPLE |
| 16 | J | — | — | — | — | — | COMPARATIVE EXAMPLE |
| 17 | K | 1174 | 1124 | 74 | GOOD | GOOD | EXAMPLE |
| 18 | L | 856 | 837 | 80 OR MORE | GOOD | GOOD | COMPARATIVE EXAMPLE |
| 19 | M | 1256 | 1240 | 62 | BAD | BAD | COMPARATIVE EXAMPLE |
| 20 | N | 1269 | 1248 | 70 | BAD | GOOD | COMPARATIVE EXAMPLE |
| 21 | O | 1252 | 1253 | 70 | BAD | GOOD | COMPARATIVE EXAMPLE |
| 22 | I | 1030 | 1002 | 62 | GOOD | BAD | COMPARATIVE EXAMPLE |
| 23 | K | 1298 | 1287 | 52 | BAD | BAD | COMPARATIVE EXAMPLE |
| 24 | K | 1311 | 1291 | 50 | BAD | BAD | COMPARATIVE EXAMPLE |
| 25 | K | — | — | — | — | — | COMPARATIVE EXAMPLE |

What is claimed is:

1. A wire material for a non-heat treated component used for manufacturing the non-heat treated component whose tensile strength is 900 MPa to 1300 MPa, containing, in mass %, C: 0.20% to 0.49%, Si: 0.05% to 2.0%, Mn: 0.20% to 1.0%, being limited to contain P: 0.030% or less, S: 0.030% or less, N: 0.005% or less, F1 defined by the following expression (1) is less than 0.60, with the balance made up of Fe and inevitable impurities, wherein a metal structure contains a pearlite structure of 64×(C %)+52% or more in a volume fraction, with the balance made up of one kind or two kinds of a pro-eutectoid ferrite structure and a bainite structure, an average block grain diameter of the pearlite structure at a region from a surface layer to 0.1 D is 15 μm or less when a diameter of the wire material is set to be D, and (the average block grain diameter of the pearlite structure at the region from the surface layer to 0.1 D)/(an average block grain diameter of the pearlite structure at a range from 0.25 D to a center) is less than 1.0, $$F1=C\ (\%)+Si\ (\%)/24+Mn\ (\%)/6 \quad (1)$$

2. The wire material for the non-heat treated component according to claim 1, further containing, in mass %, one kind or two or more kinds from among Al: 0.003% to 0.050%, Ca: 0.001% to 0.010%, Mg: 0.001% to 0.010%, Zr: 0.001% to 0.010%.

3. The wire material for a non-heat treated component according to claim 1, wherein an area ratio of a structure made up of a pearlite block whose aspect ratio is 2.0 or more is 70% or more relative to a whole pearlite structure at a region from a surface layer to 1.0 mm at a cross section in parallel to an axial direction of a steel wire which is manufactured by performing wire drawing at a total reduction of area of 15 to 800%.

4. The wire material for a non-heat treated component according to claim 1, wherein Cr, Mo, Ni, Ti, Nb, and V are contained as the impurities, and F1 is defined as C (%)+Si (%)/24+Mn (%)/6+(Cr (%)+Mo (%))/5+Ni (%)/40+(Ti (%)+Nb (%)+V (%))/5.

5. The wire material for the non-heat treated component according to claim 1, wherein a C content is 0.48% or less.

6. The wire material for a non-heat treated component according to claim 1, having a wire diameter of 8.0 mm to 15.0 mm.

7. A manufacturing method of the wire material for a non-heat treated component according to claim 1, comprising:

heating a steel billet containing, in mass %, C: 0.20% to 0.490%, Si: 0.05% to 2.0%, Mn: 0.20% to 1.0%, being limited to contain P: 0.030% or less, S: 0.030% or less, N: 0.005% or less, F1 defined by the following expression (1) is less than 0.60, with the balance made up of Fe and inevitable impurities;

hot-rolling into a wire material shape;

coiling at a coiling temperature of 800° C. to 900° C.;

cooling at a cooling rate of 20° C./s to 100° C./s from a coiling finish temperature to 600° C., further cooling at the cooling rate of 20° C./s or less from 600° C. to 550° C.;

thereafter, isothermally holding in a molten salt tank 1 at 400° C. to 600° C. and a successive molten salt tank 2 at 500° C. to 600° C. for 5 seconds to 150 seconds each; and subsequently cooling, $$F1=C(\%)+Si\ (\%)/24+Mn\ (\%)/6 \quad (1)$$

8. A steel wire for a non-heat treated component used for manufacturing the non-heat treated component whose tensile strength is 900 MPa to 1300 MPa, containing, in mass %, C: 0.20% to 0.490%, Si: 0.05% to 2.0%, Mn: 0.20% to 1.0%, being limited to contain P: 0.030% or less, S: 0.030% or less, N: 0.005% or less, F1 defined by the following expression (1) is less than 0.60, with the balance made up of Fe and inevitable impurities, wherein a metal structure contains a pearlite structure of 64×(C %)+52% or more in a volume fraction, with the balance made up of one kind or two kinds of a pro-eutectoid ferrite structure and a bainite structure, an average block grain diameter of the pearlite structure at a region from a surface layer to 0.1 D is 15 μm or less when a diameter of the steel wire is set to be D, and (the average block grain diameter of the pearlite structure at the region from the surface layer to 0.1 D)/(an average block grain diameter of the pearlite structure at a range from 0.25 D to a center) is less than 1.0, and an area ratio of a structure made up of a pearlite block whose aspect ratio is 2.0 or more is 70% or more relative to a whole pearlite structure at a region from a surface layer to 1.0 mm at a cross section in parallel to an axial direction of the steel wire, $$F1=C(\%)+Si(\%)/24+Mn(\%)/6 \quad (1)$$

9. The steel wire for the non-heat treated component according to claim 8, further containing, in mass %, one kind or two or more kinds from among Al: 0.003% to 0.050%, Ca: 0.001% to 0.010%, Mg: 0.001% to 0.010%, Zr: 0.001% to 0.010%.

10. The steel wire for a non-heat treated component according to claim 8, wherein Cr, Mo, Ni, Ti, Nb, and V are contained as the impurities, and F1 is defined as C (%)+Si (%)/24+Mn (%)/6+(Cr (%)+Mo (%))/5+Ni (%)/40+(Ti (%)+Nb (%)+V (%))/5.

11. The steel wire for the non-heat treated component according to claim 8, wherein a C content is 0.48% or less.

12. The steel wire for the non-heat treated component according to claim 8, wherein a maximum stress at distortion of 1.0 obtained by a compression test is 1200 MPa or less.

13. A manufacturing method of the steel wire for a non-heat treated component according to claim 8, comprising:

heating a steel billet containing, in mass %, C: 0.20% to 0.49%, Si: 0.05% to 2.0%, Mn: 0.20% to 1.0%, being limited to contain P: 0.030% or less, S: 0.030% or less, N: 0.005% or less, F1 defined by the following expression (1) is less than 0.60, with the balance made up of Fe and inevitable impurities;

hot-rolling into a wire material shape;

coiling at a coiling temperature of 800° C. to 900° C.;

cooling at a cooling rate of 20° C./s to 100° C./s from a coiling finish temperature to 600° C., further cooling at the cooling rate of 20° C./s or less from 600° C. to 550° C.;

thereafter, isothermally holding in a molten salt tank 1 at 400° C. to 600° C. and a successive molten salt tank 2 at 500° C. to 600° C. for 5 seconds to 150 seconds each;

subsequently cooling; and thereafter, performing wire drawing at a total reduction of area of 15% to 80%, $$F1=C(\%)+Si(\%)/24+Mn(\%)/6 \quad (1)$$

14. A non-heat treated component whose tensile strength is 900 MPa to 1300 MPa, manufactured by cold-working a steel wire containing, in mass %, C: 0.20% to 0.49%, Si: 0.05% to 2.0%, Mn: 0.20% to 1.0%, being limited to contain P: 0.030% or less, S: 0.030% or less, N: 0.005% or less, F1 defined by the following expression (1) is less than 0.60, with the balance made up of Fe and inevitable impurities, wherein a metal structure contains a pearlite structure of 64×(C %)+52% or more in a volume fraction, with the balance made up of one kind or two kinds of a pro-eutectoid ferrite structure and a bainite structure, an average block grain diameter of the pearlite structure at a region from a surface layer to 0.1 D is 15 μm or less when a diameter of the steel wire is set to be D, and (the average block grain diameter of the pearlite structure at the region from the surface layer to 0.1 D)/(an average block grain diameter of the pearlite structure at a range from 0.25 D to a center) is less than 1.0, an area ratio of a structure made up of a pearlite block whose aspect ratio is 2.0 or more is 70% or more relative to a whole pearlite structure at a region from a surface layer to 1.0 mm at a cross section in parallel to an axial direction of the steel wire, $$F1=C(\%)+Si(\%)/24+Mn(\%)/6 \quad (1)$$

15. The non-heat treated component according to claim 14, further containing, in mass %, one kind or two or more kinds from among Al: 0.003% to 0.050%, Ca: 0.001% to 0.010%, Mg: 0.001% to 0.010%, Zr: 0.001% to 0.010%.

16. The non-heat treated component according to claim 14, wherein

Cr, Mo, Ni, Ti, Nb, and V are contained as the impurities, and

F1 is defined as C (%)+Si (%)/24+Mn (%)/6+(Cr (%)+Mo (%))/5+Ni (%)/40+(Ti (%)+Nb (%)+V (%))/5.

17. The non-heat treated component according to claim 14, wherein a C content is 0.48% or less.

18. A manufacturing method of the non-heat treated component according to claim 14, comprising:

heating a steel billet containing, in mass %, C: 0.20% to 0.49%, Si: 0.05% to 2.0%, Mn: 0.20% to 1.0%, being limited to contain P: 0.030% or less, S: 0.030% or less, N: 0.005% or less, F1 defined by the following expression (1) is less than 0.60, with the balance made up of Fe and inevitable impurities;

hot-rolling into a wire material shape;

coiling at a coiling temperature of 800° C. to 900° C.;

cooling at a cooling rate of 20° C./s to 100° C./s from a coiling finish temperature to 600° C., further cooling at the cooling rate of 20° C./s or less from 600° C. to 550° C.;

thereafter, isothermally holding in a molten salt tank 1 at 400° C. to 600° C. and a successive molten salt tank 2 at 500° C. to 600° C. for 5 seconds to 150 seconds each;

subsequently cooling;

thereafter, performing wire drawing at a total reduction of area of 15% to 80%; and further, performing cold-working, $$F1=C(\%)+Si(\%)/24+Mn(\%)/6 \quad (1)$$

19. The manufacturing method of the non-heat treated component according to claim 18, wherein after the wire drawing is performed, cold-working is performed without performing a softening heat treatment.

20. The manufacturing method of the non-heat treated component according to claim 18, further comprising:

holding at 200° C. to 600° C. for 10 minutes or more after the cold-working is performed.

* * * * *